US011802750B2

(12) United States Patent
Yollu

(10) Patent No.: US 11,802,750 B2
(45) Date of Patent: Oct. 31, 2023

(54) SAFETY APPARATUS FOR GRENADE LAUNCHER ASSEMBLY

(71) Applicants: ATA SILAH SANAYI ANONIM SIRKETI, Istanbul (TR); ARMSAN SILAH SANAYI VE TICARET ANONIM SIRKETI, Istanbul (TR)

(72) Inventor: Fatih Yollu, Istanbul (TR)

( * ) Notice: Subject to any disclaimer, the term of this patent is extended or adjusted under 35 U.S.C. 154(b) by 509 days.

(21) Appl. No.: 17/049,503

(22) PCT Filed: May 17, 2019

(86) PCT No.: PCT/TR2019/050344
§ 371 (c)(1),
(2) Date: Oct. 21, 2020

(87) PCT Pub. No.: WO2020/236092
PCT Pub. Date: Nov. 26, 2020

(65) Prior Publication Data

US 2023/0111891 A1 Apr. 13, 2023

(30) Foreign Application Priority Data

May 17, 2019 (TR) ..... 2019/07457

(51) Int. Cl.
*F41A 17/42* (2006.01)
*F41A 35/06* (2006.01)
*F41C 27/06* (2006.01)

(52) U.S. Cl.
CPC ..... *F41C 27/06* (2013.01); *F41A 17/42* (2013.01); *F41A 35/06* (2013.01)

(58) Field of Classification Search
CPC .. F41C 7/11; F41C 27/06; F41A 17/42; F41A 35/06
USPC ..... 42/12, 13
See application file for complete search history.

(56) References Cited

U.S. PATENT DOCUMENTS

| | | | | |
|---|---|---|---|---|
| 7,487,612 | B2 * | 2/2009 | Macaluso | F41C 27/06 42/12 |
| 10,119,781 | B1 * | 11/2018 | Teetzel | F41C 27/06 |
| 10,578,396 | B2 * | 3/2020 | Teetzel | F41G 11/003 |
| 11,035,646 | B2 * | 6/2021 | Teetzel | F41C 23/16 |
| 11,326,854 | B2 * | 5/2022 | Yollu | F41C 27/06 |
| 2007/0068057 | A1 * | 3/2007 | Macaluso | F41C 7/025 42/105 |

(Continued)

FOREIGN PATENT DOCUMENTS

| | | |
|---|---|---|
| TR | 201808565 A | 7/2018 |
| WO | 2016089863 A2 | 6/2016 |

OTHER PUBLICATIONS

International Search Report for corresponding PCT/TR2019/050344 dated Apr. 15, 2020.

(Continued)

*Primary Examiner* — Jonathan C Weber
(74) *Attorney, Agent, or Firm* — Egbert, McDaniel & Swartz, PLLC

(57) ABSTRACT

A safety apparatus for a grenade launcher assembly which provides a dual-way ammunition feed, recognizes the direction automatically without the importance of which direction the user opens the handle in order to prevent the direction selector or movement from reversing and which does not permit opening to the other unselected side for the filling-off phase.

1 Claim, 6 Drawing Sheets

(56) References Cited

U.S. PATENT DOCUMENTS

| | | | | |
|---|---|---|---|---|
| 2012/0159829 | A1 | 6/2012 | Krutil et al. | |
| 2016/0153744 | A1* | 6/2016 | Teetzel | F41C 27/06<br>42/105 |

OTHER PUBLICATIONS

Written Opinion of the International Searching Authority for corresponding PCT/TR2019/050344 dated Apr. 15, 2020.

* cited by examiner

SAFETY APPARATUS FOR GRENADE LAUNCHER ASSEMBLY

TECHNICAL FIELD

The invention relates to a modular grenade launcher assembly which use of ammunition.

In particular, the invention relates to safety apparatus for grenade launcher assembly that selects the direction or prevents movement from reversing which can be supplied with bi-directional ammunition.

BACKGROUND OF THE INVENTION

Today, weapons used in the defense industry to throw bombs are called grenade launchers. The reason for the use of grenade launchers is that they can throw the bomb away more quickly and more accurately than the manual shot.

The grenade launchers, usually mounted under the rifles, are now being designed on 2 different models with different application connections.

Today, weapons used in the defense industry to throw bombs are called bombs. The reason for the use of bomb beats is that they can throw the bomb away more quickly and more accurately than the manual shot.

The grenade launchers, usually mounted under the rifles, are now being designed on 2 different models with different application connections.

The first method is based on the working principle of opening and unloading of the barrel with one joint connection.

The second method allows the filling and unloading of both the right and left sides with the forward movement of the barrel.

In the case of unilateral opening, it is seen that the said grenade launchers do not provide convenience to each user.

The ammunition filling and unloading process cannot be done as fast as required in both models.

The direction of feeding in firearms, which can be used as two-way ammunition, which is used today, varies according to the user.

When the system is intended to be fed again in the desired direction, it can be opened again instead of closing because there is no additional mechanism to prevent it from opening in the other direction.

This leads to problems such as loss of time, falling of ammunition. Considering the firearms especially used for military purposes, the percentage of such errors is very high and risk in case of excitement and panic.

In the PCT application WO2016/089863 in the literature, relates to a modular grenade launcher system includes an upper chassis and subframe connected to opposite sides of a gun barrel, such as a firearm. This chassis is mounted so that any of the many interchangeable modules, including bomb calendars with different calibers, are removed. A separate, modular and removable firing mechanism is provided, wherein a plurality of bomb disposal devices can share a common firing mechanism. An auxiliary rail module is provided to replace the bomb-throwing barrel assembly and the firing mechanism.

In the aforementioned application, a modular grenade launcher system comprising a trigger device and a barrel assembly is disclosed.

In the European Patent application EP2478322B1 in the literature, relates to a barreled firearm which allows to change the direction of lying of the barrel and includes a rear block for fixing the barrel, the rear block includes a locking surface on a portion of its circumference and thus locking the firearm The surface is fixed against lying in the opposite direction of the surface. In order to change the direction of rotation of the barrel, the locking surface may be rotatable about the longitudinal axis of the rear block.

In the aforementioned application, a firearm structure with a lying barrel is described.

Due to the abovementioned disadvantages, a safety apparatus for grenade launcher assembly was required.

DISCLOSURE OF THE INVENTION

The object of the invention is to provide a new modular grenade launcher which eliminates the disadvantages of the present invention.

Another object of the invention is to select the direction or prevents movement from reversing which can be supplied with bi-directional ammunition.

Another object of the invention is to provide a structure in which the user can move the system in the desired direction without using another button, lever or bolt.

Another object of the invention is to provide a system which does not matter to which side the user opens a firearm, so that the system automatically recognizes the direction and does not allow it to open to the other unselected side for that fill-off stage.

Another object of the invention is to provide a structure in which the mechanical system is self-resetting when the gun is locked to wait for a second fill-out operation and again expects the user to select the direction.

Another object of the invention is to provide a structure that avoids problems such as loss of time experienced by users and the fall of ammunition.

REFERENCE NUMBERS

A—Grenade Launcher Assembly
B—Safety Apparatus
1. Folding Tab
2. Tab Slot
3. Handle
4. Tab Locking Plate
5. Centering Spring
6. Pin
7. Tab Spring

DETAILED DESCRIPTION OF THE INVENTION

In this detailed description, the invention is described with examples that will not have any limiting effect for better understanding of the subject matter.

The invention relates to the safety apparatus (B) for grenade launcher assembly (A) which provides a dual-way ammunition feed, recognizes the direction automatically without the importance of which direction the user opens the handle (3) in order to prevent the direction selector or movement from reversing and which does not permit opening to the other unselected side for the filling-off phase characterized in that; comprises a folding tab (1) positioned on said safety apparatus (B) and tab locking plate (4) positioned on the handle (3) which interlock each other to prevent unintentionally passing the extra hand to the unselected side during the movement of said handle (3) to the first position after moving left/right to load ammunition.

Figure 1:
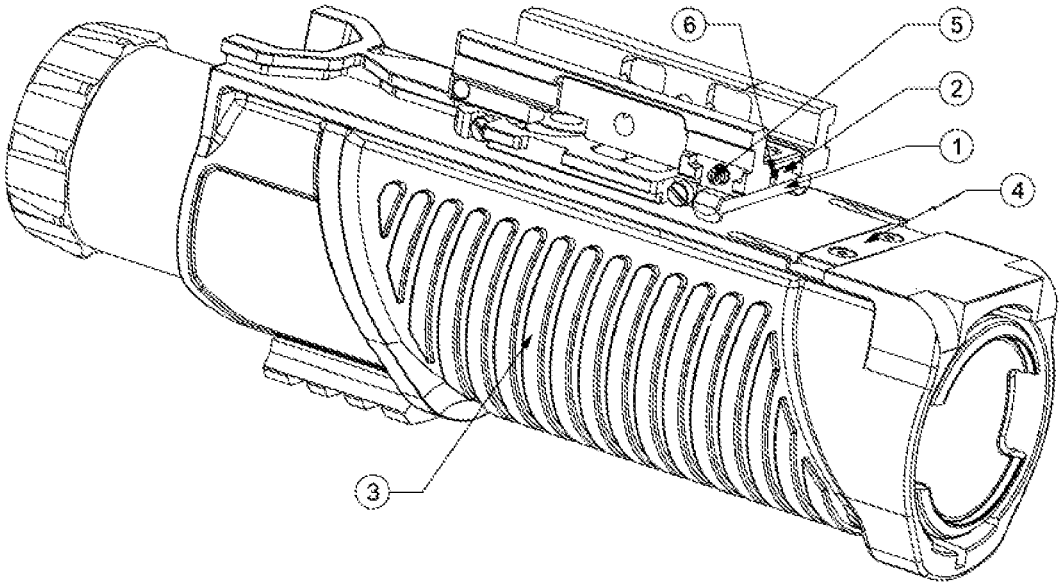
FIG. 1 is a perspective view of the grenade launcher assembly according to the invention.

FIG. 1 shows a perspective view of the grenade launcher assembly according to the invention.

Figure 2:
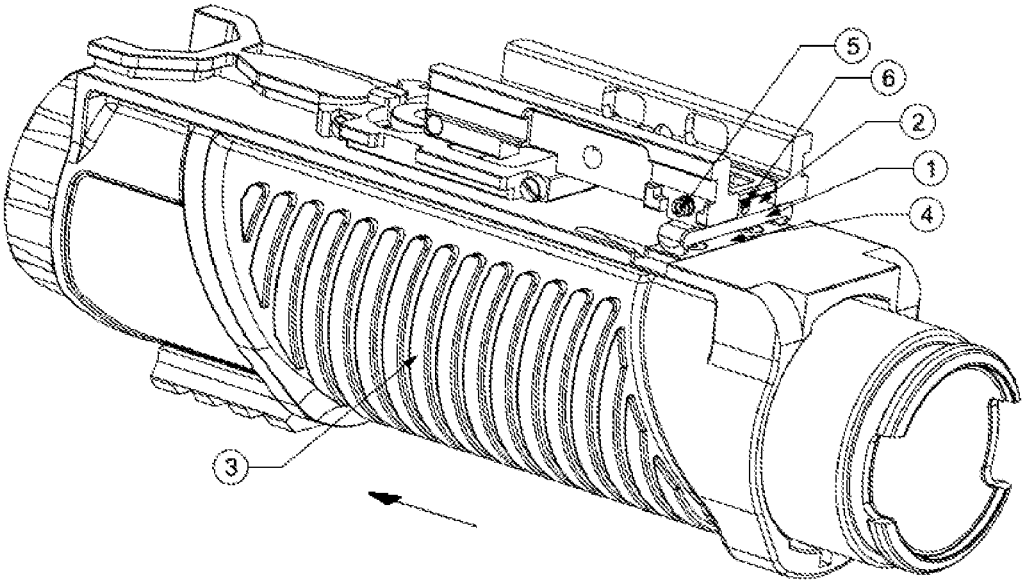
FIG. 2 is another perspective view of the grenade launcher assembly according to the invention.

FIG. 2 shows another perspective view of the grenade launcher assembly according to the invention.

Figure 3:
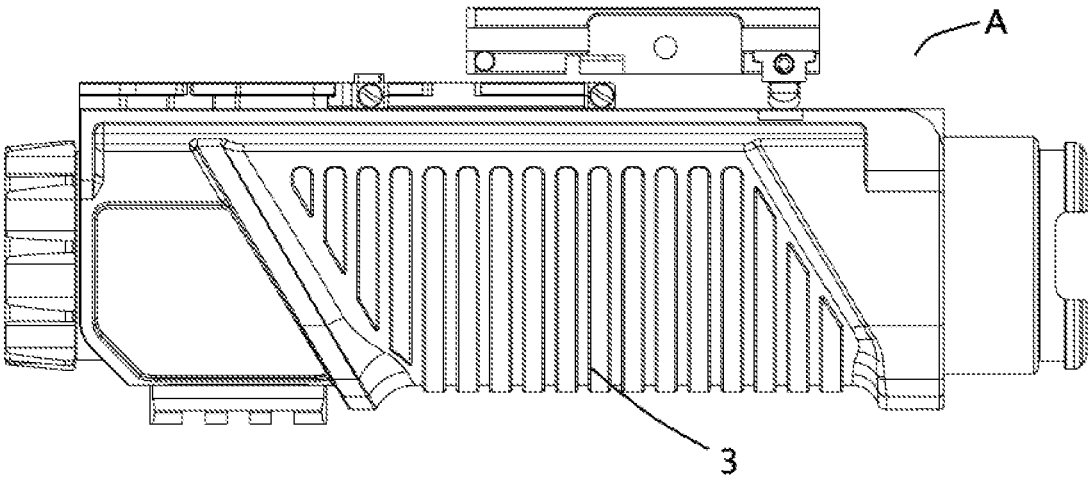
FIG. 3 is a side view of the grenade launcher assembly according to the invention

FIG. 3 shows a side view of the grenade launcher assembly according to the invention.

Figure 4:
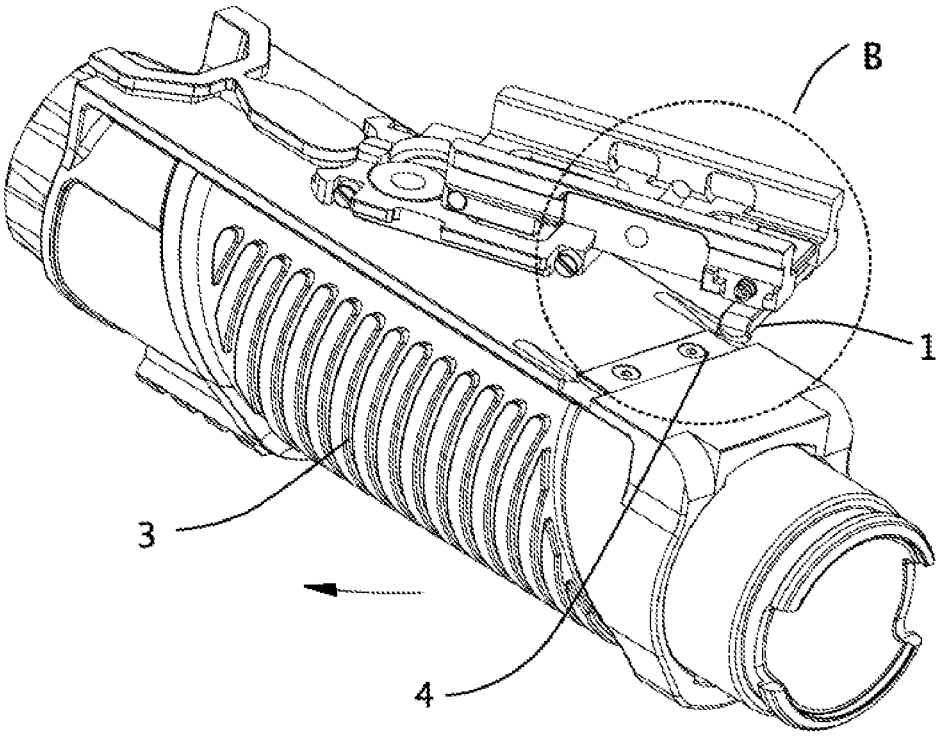
FIG. 4 is a perspective view of the handle rotated to the left in the grenade launcher assembly according to the invention.

FIG. 4 shows a perspective view of the handle rotated to the left in the grenade launcher assembly according to the invention.

Figure 5:
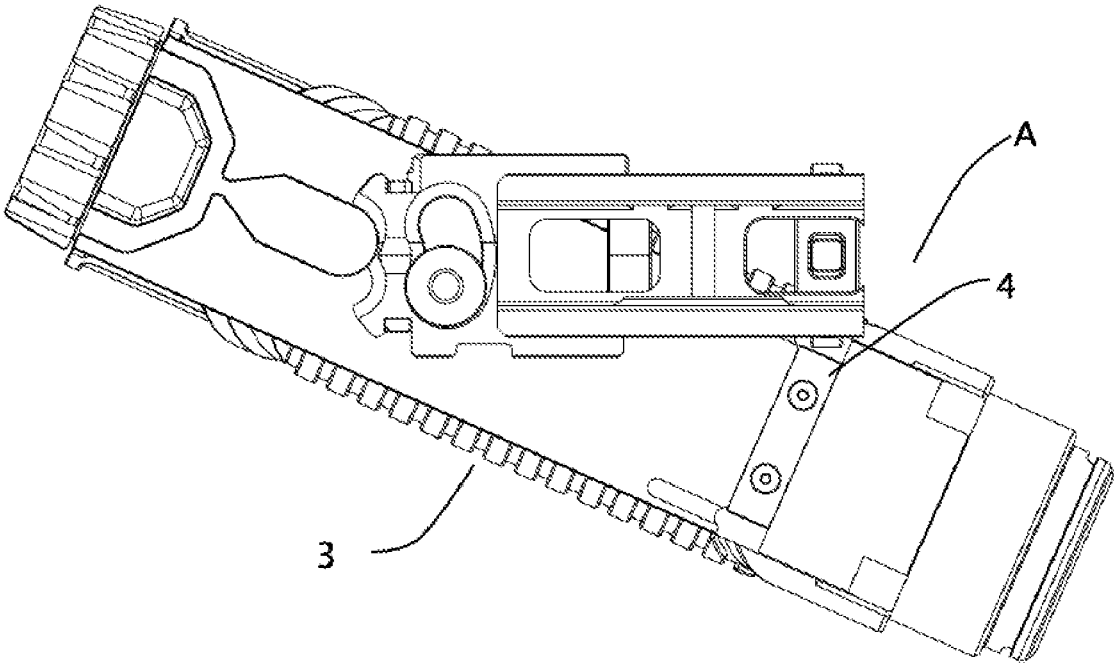
FIG. 5 is a top view of the handle rotated to the left in the grenade launcher assembly according to the invention.

FIG. 5 shows a top view of the handle rotated to the left in the grenade launcher assembly according to the invention.

Figure 6:
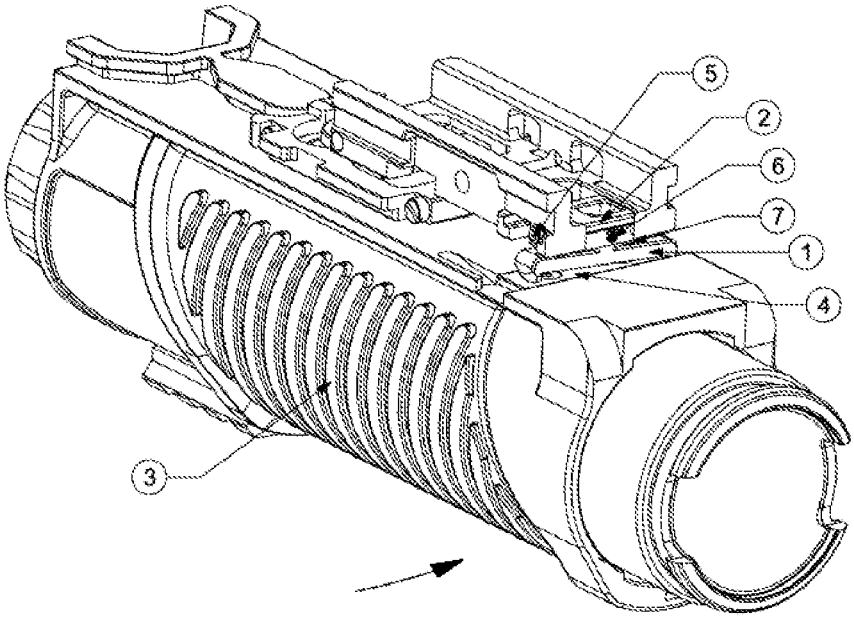
FIG. 6 is a perspective view of the invention in which the handle is mounted in its former position.

FIG. 6 shows a perspective view of the invention in which the handle is mounted in its former position.

Figure 7:
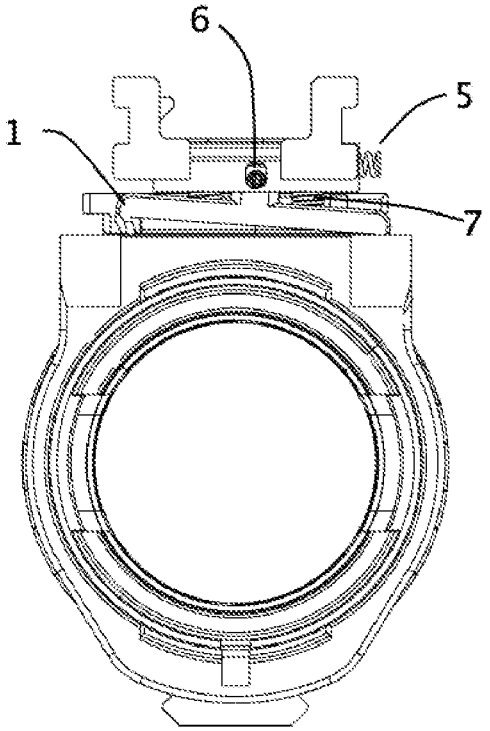
FIG. 7 is a front view of the grenade launcher assembly according to the invention which the handle is mounted in its former position.

FIG. 7 shows a front view of the grenade launcher assembly according to the invention which the handle is mounted in its former position.

Figure 8:
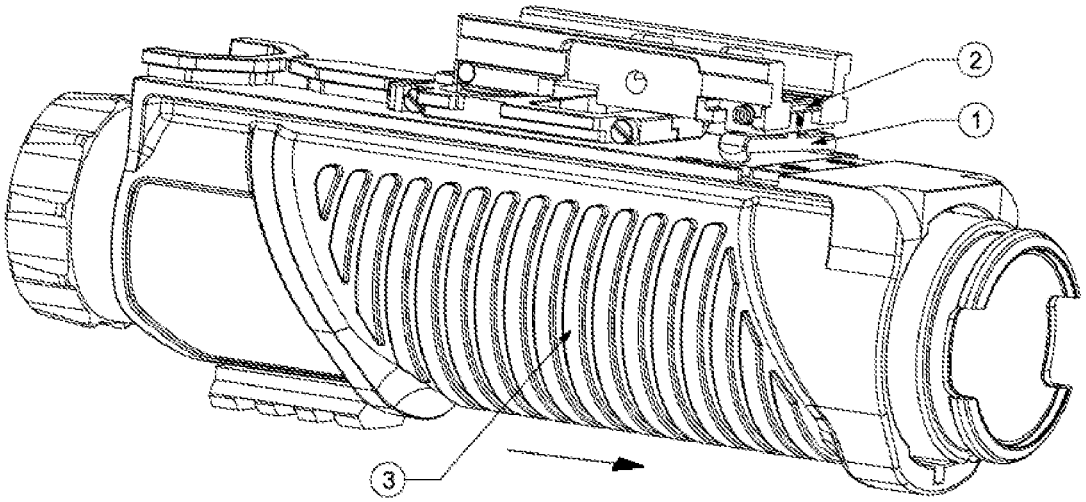
FIG. 8 is a perspective view of a handle in its first closed position of the grenade launcher assembly according to the invention.

FIG. 8 shows a perspective view of a handle in its first closed position of the grenade launcher assembly according to the invention.

Figure 9:
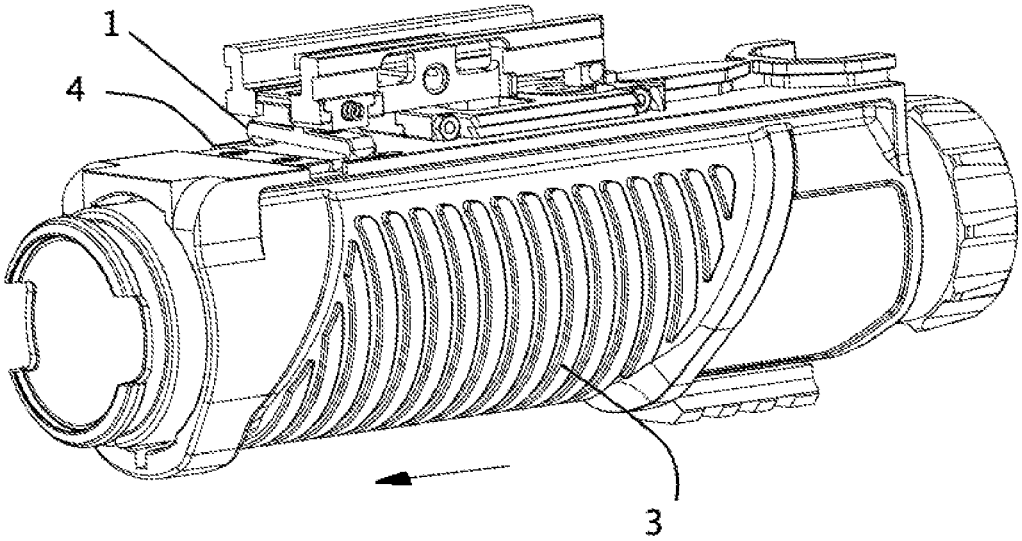
FIG. 9 is another perspective view of the handle in the first closed position of the grenade launcher assembly according to the invention.

FIG. 9 shows another perspective view of the handle in the first closed position of the grenade launcher assembly according to the invention.

Figure 10:
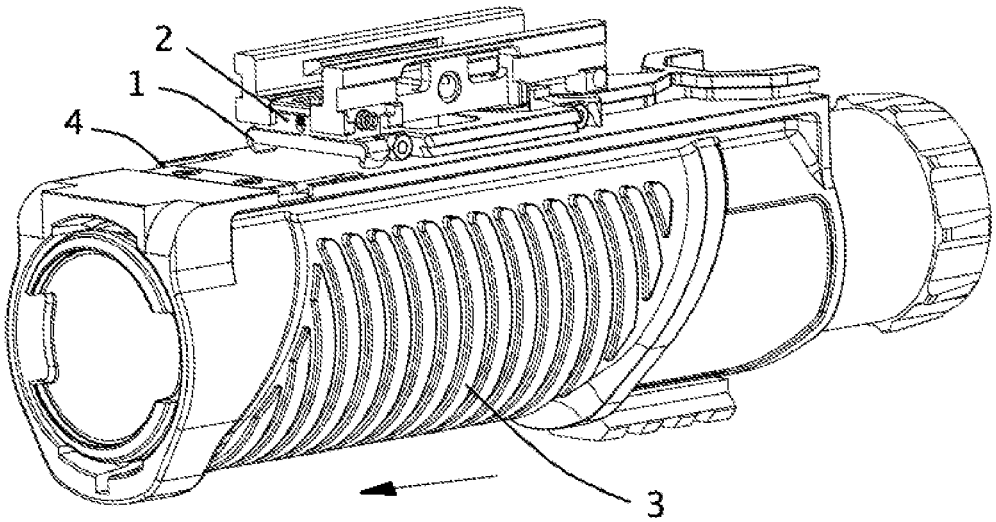
FIG. 10 is another perspective view of the handle in the first closed position of the grenade launcher assembly according to the invention.

FIG. 10 shows another perspective view of the handle in the first closed position of the grenade launcher assembly according to the invention.

Figure 11:
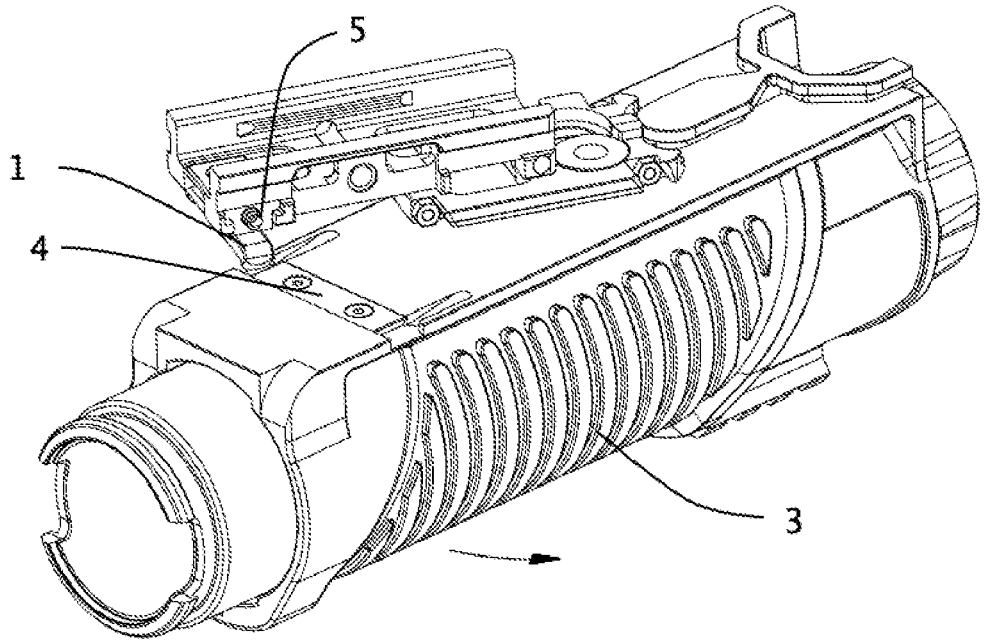
FIG. 11 is a perspective view of a handle rotated to the right in the grenade launcher assembly according to the invention.

FIG. 11 shows a perspective view of a handle rotated to the right in the grenade launcher assembly according to the invention.

Figure 12:
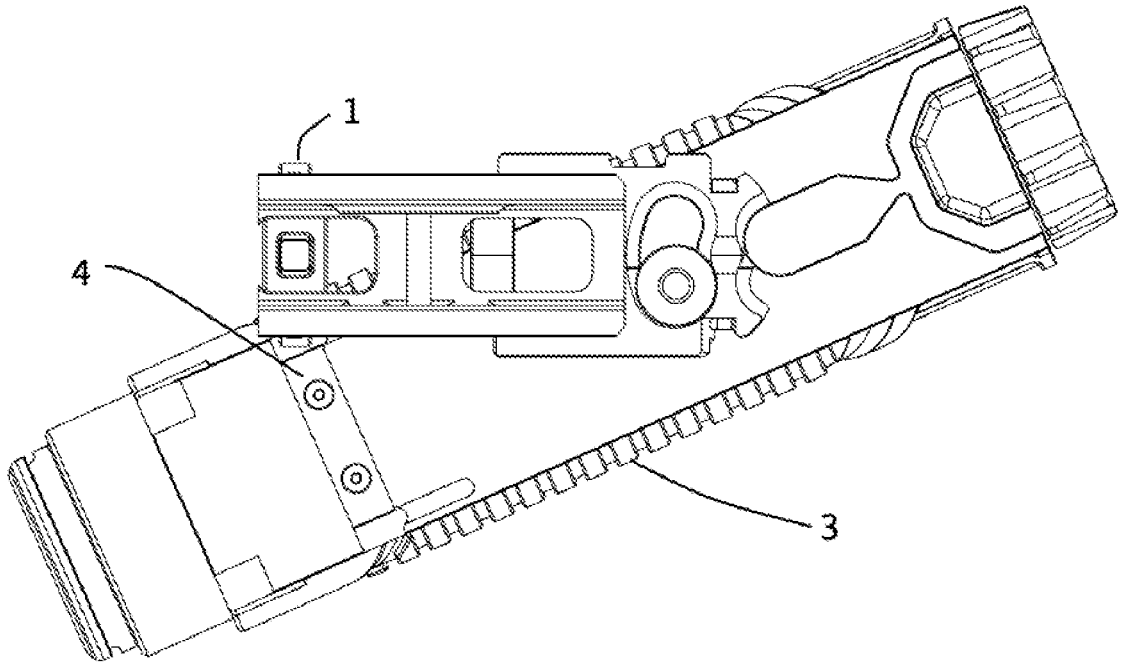
FIG. 12 is a top view of the handle rotated to the right in the grenade launcher assembly according to the invention.

FIG. 12 shows a top view of the handle rotated to the right in the grenade launcher assembly according to the invention.

The safety apparatus (B) for grenade launcher assembly (A) according to the invention, consists of main parts that; a folding tab (1), a tab slot (2), a handle (3), a tab locking plate (4), a centering spring (5), a pin (6), a tab spring (7).

When said handle (3) is released, the tab locking plate (4) comes up to the level of the safety apparatus (B) together with the handle (3). In this case, the folding tab (1) expects the user to perform the initial movement.

Said handle (3) is moved to the left for ammunition feeding and the folding tab (1) hangs down by means of the tab spring (7).

When said handle (3) is moved back to its original position, tab locking plate (4) and the folding tab (1) are locked together and the movement is prevented from moving to the opposite side. Said tab spring (7) assists the folding tab (1) and the tab locking plate (4) on one another, by moving the handle (3) to the left/right for ammunition feeding so that said folding tab (1) hangs down slightly.

Because of the interlocking tab locking plate (4) and the folding tab (1), the tab slot (2) moves slightly in the closing direction and carries all parts of the safety apparatus (B) so that the handle (3) can reach the center.

When the said handle (3) is brought back to its first closed position, the folding tab (1) is released from the tab locking plate (4) and is moved from the ramp to the waiting point in handle (3) and the centering springs (5) push the tab slot (2) and the safety apparatus (B) to the center.

In another embodiment of the present invention, the said handle (3) is moved to the right for ammunition feeding and the folding tab (1) hangs down by the tab spring (7).

Similarly, when the handle (3) is brought to its initial position, the tab locking plate (4) and the folding tab (1) are locked together to prevent it from being unintentionally moving to the extra-left.

Thus, a structure that prevents the movement in the opposite direction is presented.

The invention claimed is:

1. An apparatus comprising:

a grenade launcher having a handle, said grenade launcher having a tab locking plate positioned on the handle;

a safety apparatus mounted swingingly to said grenade launcher, said safety apparatus having a folding tab positioned thereon, the folding tab having an interlocking position with the tab locking plate so as to prevent movement of the handle during loading of ammunition into said grenade launcher, said safety apparatus having a tab spring bearing on the folding tab so as to urge the tab locking plate into the interlocking position with the folding tab such that the folding tab moves slightly downward after the handle is moved swingingly left or right during the loading of ammunition, wherein said safety apparatus has a tab slot cooperative with the handle so as to urge the handle toward a center position, wherein said safety apparatus has a centering spring that urges on the tab slot when the folding tab is released from the tab locking plate.

* * * * *